United States Patent [19]

Glennon et al.

[11] 4,164,035

[45] Aug. 7, 1979

[54] SURGE CONTROL FOR VARIABLE SPEED-VARIABLE GEOMETRY COMPRESSORS

[75] Inventors: Timothy F. Glennon; Theodore E. Sarphie, both of Rockford, Ill.

[73] Assignee: Sundstrand Corporation, Rockford, Ill.

[21] Appl. No.: 833,033

[22] Filed: Sep. 14, 1977

[51] Int. Cl.[2] ..... F02C 9/14; F04D 27/02

[52] U.S. Cl. ..... 364/431; 60/39.29; 415/17; 415/39

[58] Field of Search ..... 364/431; 340/27 SS; 415/1, 27, 28; 73/115-117; 60/39.29

[56] References Cited

U.S. PATENT DOCUMENTS

| | | | |
|---|---|---|---|
| 3,138,317 | 6/1964 | Jekat | 415/148 |
| 3,292,845 | 12/1966 | Hens et al. | 415/17 |
| 3,292,846 | 12/1966 | Harper et al. | 415/17 |
| 3,411,702 | 11/1968 | Metot et al. | 415/27 |
| 3,424,370 | 1/1969 | Law | 415/27 |
| 3,849,021 | 11/1974 | Eastman et al. | 415/30 |
| 3,852,958 | 12/1974 | Adams et al. | 340/27 SS |
| 3,867,717 | 2/1975 | Moehring et al. | 364/431 |
| 3,868,625 | 2/1975 | Speigner et al. | 340/27 SS |
| 3,876,326 | 4/1975 | Weitz | 415/17 |
| 3,935,558 | 1/1976 | Miller et al. | 340/27 SS |
| 4,077,203 | 3/1978 | Burnell | 60/39.29 |

*Primary Examiner*—Felix D. Gruber

*Attorney, Agent, or Firm*—Wegner, Stellman, McCord, Wiles & Wood

[57] ABSTRACT

Surge control systems prevent and control a surge condition for fixed or variable speed compressors and compressors having variable geometry which provide air to pneumatic loads. A signal proportional to the ratio of the measured compressor outlet pressure to the measured inlet pressure is combined with a signal corresponding to a selected reference pressure to provide a vent valve command signal. When the signal representing the ratio of the measured pressure exceeds the signal corresponding to the selected reference pressure, a surge condition is developing and the vent valve command signal causes a valve to vent a portion of the air to the pneumatic load. The venting of the air reduces the measured pressure ratio and the vent valve command signal decreases, to close the valve. A signal is provided to reduce the effect of the reference pressure ratio if the weight flow rate through the compressor is reduced, as by decreasing compressor speed and/or repositioning the inlet guide vanes of the compressor.

13 Claims, 5 Drawing Figures

SURGE CONTROL FOR VARIABLE SPEED-VARIABLE GEOMETRY COMPRESSORS

BACKGROUND OF THE INVENTION

This invention relates to control systems for controlling the operation of gas compressor systems to avoid a surge condition and, more particularly, to a system for regulating the ratio of the outlet pressure to the inlet pressure to prevent surge.

Gas compressor systems which supply air pressure to pneumatic loads are subject to the occurrence of an undesirable condition commonly referred to as surge. Although the reason for the occurrence of surge is not fully understood, its effect is extremely detrimental. For example, when a surge condition occurs in the compressor system, the airflow may suddenly reverse and airflow provided to the pneumatic load may cease or be interrupted. If the surge condition is permitted to continue, the compressor can enter a deep surge condition, causing damage to its internal components.

SUMMARY OF THE INVENTION

In accordance with the present invention, a signal representing a pressure ratio, $P_r$, of the outlet pressure of the compressor to the inlet pressure of the compressor is combined with a signal representative of a selected pressure ratio, $P_r$ ref., to provide a vent valve command signal. The reference pressure ratio $P_r$ ref. may be selected to correspond to a maximum flow rate W through the compressor. If the signal representing the measured pressure ratio $P_r$ is greater than the signal representing the reference pressure ratio $P_r$ ref. for the selected weight flow rate W, a surge condition may ensue and the valve position command signal causes a valve to vent a portion of the air provided to the load.

The venting of the air reduces the output pressure of the compressor, thereby lowering the pressure ratio $P_r$. As the pressure ratio $P_r$ returns to value equal to the reference pressure $P_r$ ref., the valve position command signal closes the venting valve and system operation along the normal operating line of the compressor resumes. A signal representing a reduction in reference pressure $P_r$ is provided to accommodate a lesser weight flow rate W if the weight flow rate W is reduced, as decreasing the speed of the compressor and/or repositioning its inlet guide vanes. Addition of the signal has the effect of reducing $P_r$ ref.

It is an object of the invention to provide an electrical control system for preventing and controlling a surge condition in a compressor system.

Another object is to prevent surge by controlling the pressure ratio of the outlet pressure to the inlet pressure by venting a portion of the air provided to the pneumatic load.

Another object of the invention is to control surge when the pressure ratio is reduced as by operating the compressor at less than maximum speed or at a reduced weight flow rate due to the position of the inlet guide vanes, or both.

Other objects and features of the invention will be apparent from the following description and from the drawings. While illustrative embodiments of the invention are shown in the drawings and will be described in detail herein, the invention is susceptible of embodiment in many different forms, and it should be understood that the present disclosure is to be considered as an exemplification of the principles of the invention and is not intended to limit the invention to the embodiments illustrated.

DESCRIPTION OF PREFERRED EMBODIMENT

Figure 1:
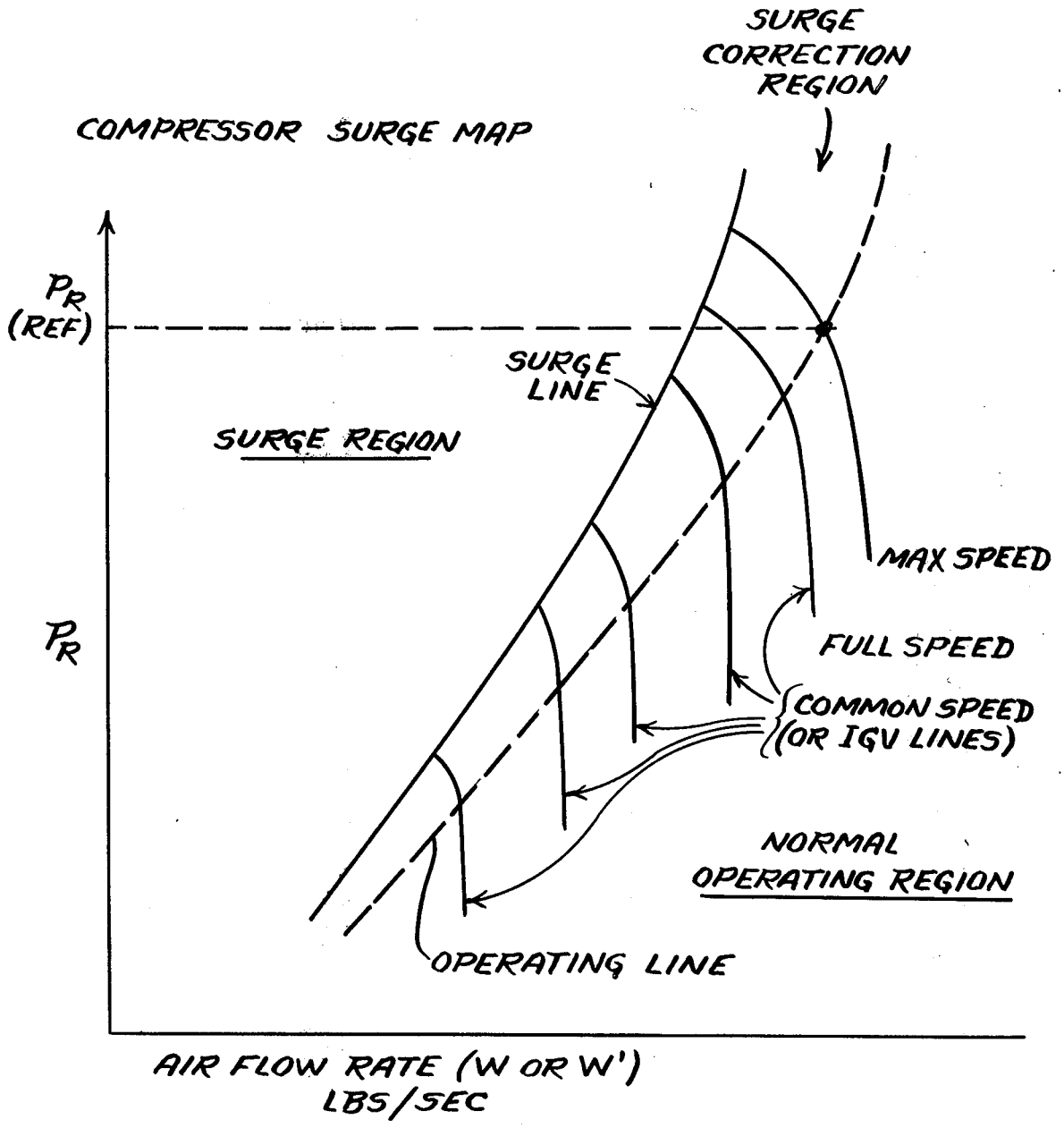
FIG. 1 is a diagram of a compressor surge map for the type of compressor contemplated by the present invention.

Referring to FIG. 1, a surge map for a load compressor is shown. The map shows a pressure ratio $P_r$ plotted as a function of airflow rate W. $P_r$ is the ratio of the outlet pressure $P_{out}$ to the inlet pressure $P_{in}$. Airflow rate W is the weight of the air discharged from the compressor as the function of time (as, for example, lbs. per second). The airflow rate may also be corrected for temperature and pressure variations, in which case the value is denoted by W'.

Both $P_r$ and W are obtained by measuring various compressor parameters. $P_{in}$ may be obtained by measuring the pressure at the inlet of the compressor by a pressure tube. $P_{out}$ may be similarly measured by a pressure tube positioned at the outlet of the compressor. The pressures are converted to electrical signals which are manipulated to provide $P_r$. W or W' are proportional to a differential pressure measured at the input of the compressor. Hence, the differential pressure at the input is converted to an electrical signal and multiplied by a constant to provide W or W'.

The surge line on the map is acquired empirically by detecting and plotting values of $P_r$ at which the compressor enters a surge condition for selected values of W. The speed of the compressor and the position of its inlet guide vanes (IGV) affect the location of the operating position on the map, and movement on the map is along the common speed (or common IGV) line. For example, at a constant compressor speed, $P_r$ increases without an increase in airflow rate until the compressor reaches the surge condition, as can be seen by following a common speed line upwardly to the surge line, as shown in FIG. 1.

The magnitude of $P_r$ for a given W can be controlled by controlling $P_{out}$ for a particular airflow rate. This may be accomplished by venting a portion of the air provided to the load. As air is vented, $P_{out}$, and hence $P_r$, drops, following the common speed line downwardly from the surge line. The compressor operating line is drawn in the normal operating region of the map and is selected to represent a displacement, as 5%, to the right of the surge line. It is desirable that the system maintain a pressure ratio $P_r$ greater than the $P_r$ value at the intersection of the operating line with the common speed line (or inlet guide vane position line) but less than the $P_r$ value at the intersection of the surge line and the common speed line.

In the present invention, the pressure ratio $P_r$ is controlled by a venting valve which increases or decreases $P_{out}$ so that $P_r$ equals the $P_r$ value at the intersection of the common speed line with the operatng line. The valve is opened or closed when the $P_r$ value is in the surge correction region, as shown in FIG. 1. The position of the valve determines the value of $P_r$ and is controlled by a surge control circuit to be explained in greater detail below.

If the compressor is operating in surge condition (on the surge line), the valve is fully opened. If the compressor is operating in the normal operating region (on the operating line), the valve is fully closed. Proportional control of the valve position occurs when $P_r$ is in the surge correction region. As the valve is opened, the pressure ratio $P_r$ drops along the common speed line toward the point of intersection with the normal operating line. As the pressure ratio approaches the normal operating line, the control valve of the present invention proportionally closes the valve and completely closes it when the pressure ratio $P_r$ lies at the intersection of the operating line. Thereafter, if the pressure ratio increases to enter the surge correction region, the control system of the present invention opens a valve in an amount proportional to the magnitude of the correction required to drop the pressure back toward the operating line.

An explanation of the operation of various control systems for the compressors will now be provided with particular reference to an axial compressor. Although an axial compressor will be described in combination with the control circuits, it should be understood that the control circuits of the present invention are capable of controlling surge for any type of compressor having a surge map similar to that shown in FIG. 1.

Figure 2:
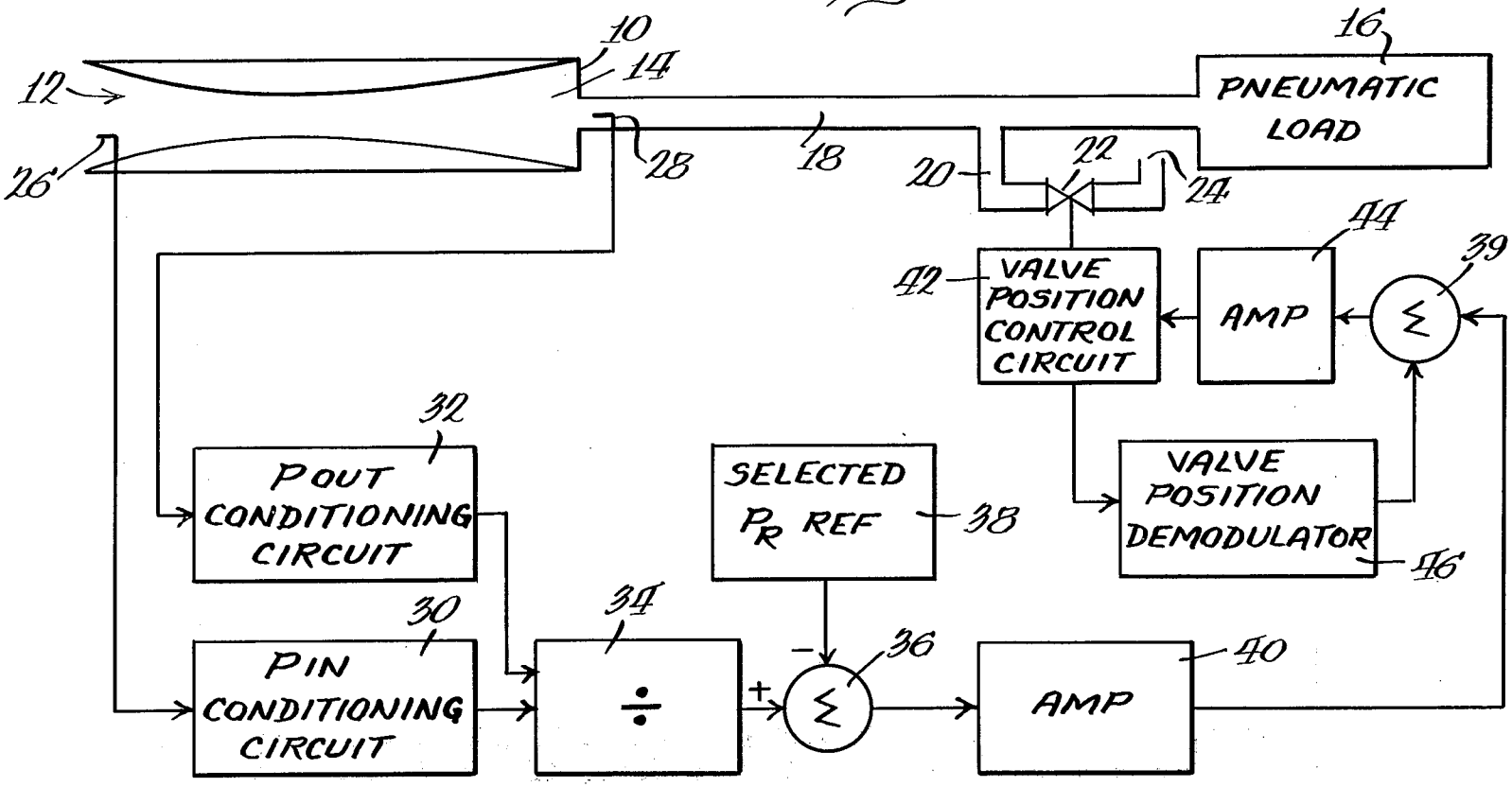
FIG. 2 is a block diagram of a surge control system for a fixed speed, fixed geometry compressor.

Referring to FIG. 2, a surge control system for a fixed speed, fixed geometry compressor is shown. A compressor 10 has an inlet 12 and an outlet 14 which supplies compressed air to pneumatic loads 16 by a pneumatic conduit 18 which is coupled between the load 16 and the outlet 14. A venting conduit 20 is coupled in parallel with load 16 and has a dump valve 22 therein, the position of which determines the amount of air vented by vent 24. A pressure sensor 26, which may be a conventional or strain gauge transducer, measures the pressure at the inlet 12 and converts it to a signal $P_{in}$ representative of the magnitude of the pressure. Similarly, a sensor 28 measures the pressure at outlet 14 and generates a signal $P_{out}$ proportional to its magnitude.

The singals representing $P_{in}$ and $P_{out}$ are applied to conditioning circuits 30 and 32, respectively. The conditioning circuits remove noise and transients from the signals. The signals are then appllied to a divider circuit 34 which divides the $P_{out}$ signal by the $P_{in}$ signal to provide output singal $P_r$. The output from divider circuit 34 is applied to a sumer 36 where it is summed with a singal from $P_r$ reference circuit 38. The level of the signal from the $P_r$ reference circuit 38 is set equal to the desired pressure ratio $P_r$ ref. at the intersection of the common speed line representing maximum flow rate W and the operating line (FIG. 1).

The output of summer 36 is referred to as the vent valve position command signal and is negative when the compressor is operating in the normal operating region since the value from $P_r$ reference circuit is greater than the value from divider circuit 34. If the pressure ratio $P_r$ (which follows a common speed or IGV line) exceeds the selected $P_r$ ref., the valve position command signal from summer 36 is positive. This position on the surge map of FIG. 1 is located in the surge correction region and is indicative of an ensuing surge condition. When $P_r$ is in this section of the surge map, valve 22 must be opened to reduce $P_r$ so that a surge condition does not occur. The magnitude and the polarity of the valve position command signal controls the position of valve 22, as will be explained in greater detail below.

The valve position command signal is applied to a summer 39 through an amplifier 40. The gain of amplifier 40 is selected in accordance with the operating characteristics of the system. A voltage applied to a summer 39 causes an output voltage to be provided to a valve position control circuit 42 through an amplifier 44. The position of the valve is related to the voltage applied to valve position control circuit 42 in any convenient manner. For example, a positive voltage applied to the valve position control circuit 42 may be used to open valve 22 in an amount proportional to the mangnitude, whereas zero volts, or negative voltage, causes valve 22 to be fully closed.

Valve position demodulator circuit 46 provides negative feedback to summer 39 to assure that the valve position with respect to the applied voltage is maintained. If $P_r$ increases and enters the surge control region on the map of FIG. 1, the valve position command signal is positive and causes valve 22 to open. When valve 22 opens, $P_r$ decreases, which in turn decreases the magnitude of the valve position command signal causing valve 22 to close. When the valve position command signal decreases to zero or becomes negative the valve 22 is fully closed and the compressor is operating in the normal operating region.

Figure 3:
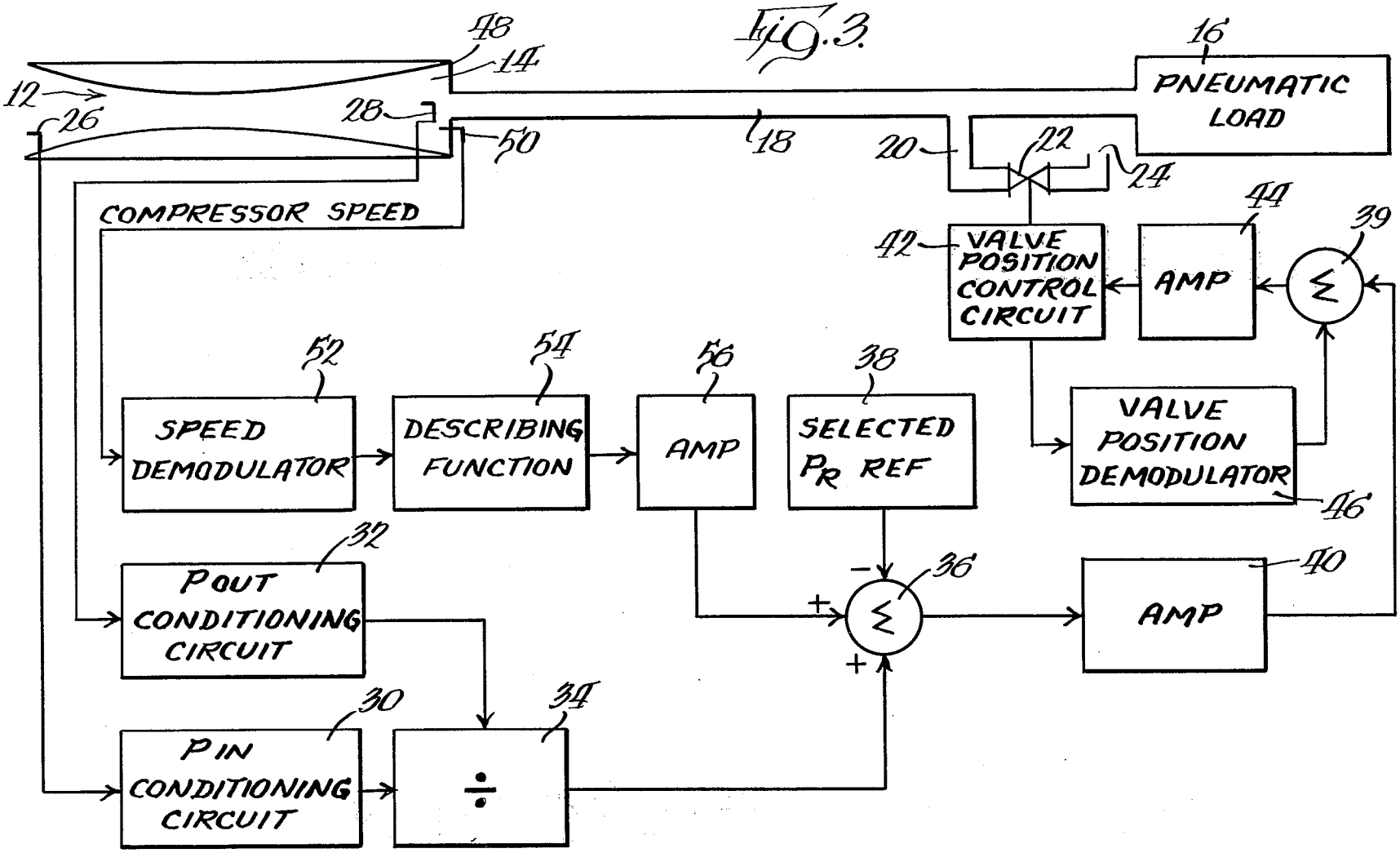
FIG. 3 is a block diagram of a surge control system for a variable speed, fixed geometry compressor.

Referring to FIG. 3, a surge control system for a variable speed, fixed geometry compressor 48 is provided. The system shown in FIG. 3 is similar to the system shown for the fixed speed, fixed geometry system of FIG. 2. The difference between the two systems is easily seen in that valve position command signal from summer 36 is modified by a signal representing various compressor speeds. Specifically, as the speed of the compressor is selectively decreased to a percentage of full speed, the value of $P_r$ on the operating line also decreases. FIve different speeds are shown in FIG. 1, and each represents a selected percentage of full speed.

The speed of compressor 48 is sensed by a sensor 50 to provide a signal proportional to the acutal speed. A speed demodulator circuit 52 converts the signal representing the actual speed to a proportional voltage. A describing function 54 provides an output to summer 36 through an amplifier 56. The gain of amplifier 56 is selected in accordance with the operating parameters of the system. As the various speeds are selected in decreasing magnitude, the output of the describing function 54 increases. The relationship between the input and the output is usually linear, although a describing function other than linear may be used if desired. The describing function may also modify the input signal for altitude, temperature or pressure.

The valve position command signal from summer 36 is similar to that discussed above with respect to the fixed speed, fixed geometry compressor (FIG. 2), except that its magnitude is proportional to a reduced value of $P_r$ indicative of a reduction in the selected speed. Thus, for the five common speeds shown in FIG. 1, the describing function 54 and amplifier 56 provide five individual voltage levels, each of which reduces the effect of $P_r$ ref. so that the signals generated by the circuit correspond to the $P_r$ at the intersection of the operating line with the selected common speed line. The valve position command signal from summer 36 controls the position of valve 22 in a manner similar to that discussed above.

Figure 4:
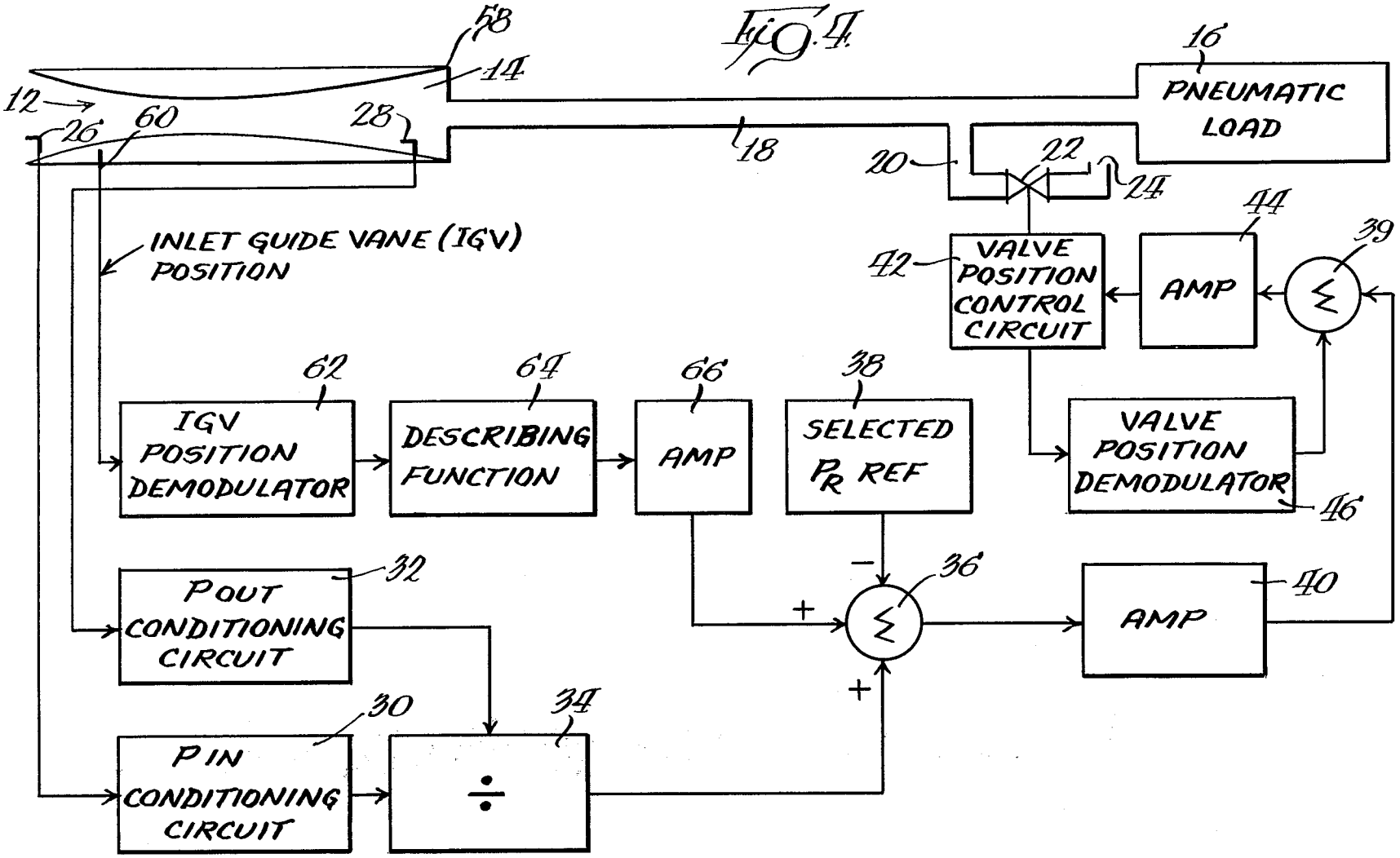
FIG. 4 is a block diagram of a surge control system for a fixed speed, variable geometry compressor.

Referring to FIG. 4, a surge control system for a fixed speed, variable geometry compressor 58 is shown. For the purpose of this invention, the term "variable geometry compressor" means a compressor having positionable inlet guide vanes which control the weight flow rate through the compressor. The surge control system shown in FIG. 4 is similar to the system shown for the fixed speed system in FIG. 2. The difference between the two systems is easily seen in that the valve position command signal from summer 36 is modified by a signal representing the various inlet guide vane positions of the compressor. Specifically, as the inlet guide vanes (IGV) are positioned in a angular relationship with respect to the position representing maximum weight flow W, the value of $P_r$ along the operating line decreases in a manner similar to the effect of a reduction in compressor speed. Five different inlet guide vane positions are shown in FIG. 1, and each represents a selected angular relationship with repsect to the position representing maximum weight flow W. The IGV position is sensed by a sensor 60 to provide a signal proportional to the actual position of the inlet guide vanes. An IGV position demodulator 62 converts the signal representing the IGV position to a proportional voltage. Describing function 64 provides an output to summer 36 through an amplifier 66. The gain of amplifier 66 is selected in accordance with the operating parameters of they system. As the inlet guide vanes are positioned to decrease the magnitude of the weight flow rate, the output from the describing function 64 increases.

The valve position command signal from summer 36 is similar to that discussed above with respect to FIG. 2, except that its magnitude is reduced by an amount proportional to the $P_r$ drop indicative of a lower weight flow rate W due to the selection of a particular inlet guide vane position. Thus, for the five IGV lines shown in FIG. 1, the describing function 64 and amplifier 66 provide five individual voltage levels, each of which has the effect of reducing $P_r$ ref. so that the circuit provides a signal representative of the pressure ratio having a value equal to the value of $P_r$ at the intersection of the operating line with the IGV line.

The operation of the variable speed, variable geometry compressor will now be considered. However, before the details of the surge control system for the variable speed, variable IGV system are provided, it is helpful to consider the nature of the surge control map for such a compressor. If both the speed and the geometry of the compressor are permitted to be controlled, the surge mapping function becomes three-dimensional. Specifically, individual maps, each of which represents a common speed and each of which is similar to that shown in FIG. 1, are provided for each inlet guide vane position. Thus, the particular value of $P_r$ for a selected flow rate W is determined not only by the speed of the compressor, but also by the inlet guide vane position. Since both the inlet guide vane position and the speed of the compressor affect the position of $P_r$ on an operating line for a particular flow rate, signals representing both these parameters must be added to the signal representing $P_r$ ref., having the effect of reducing $P_r$ ref. to accommodate the selected comparison speed and selected inlet guide vane position.

Figure 5:
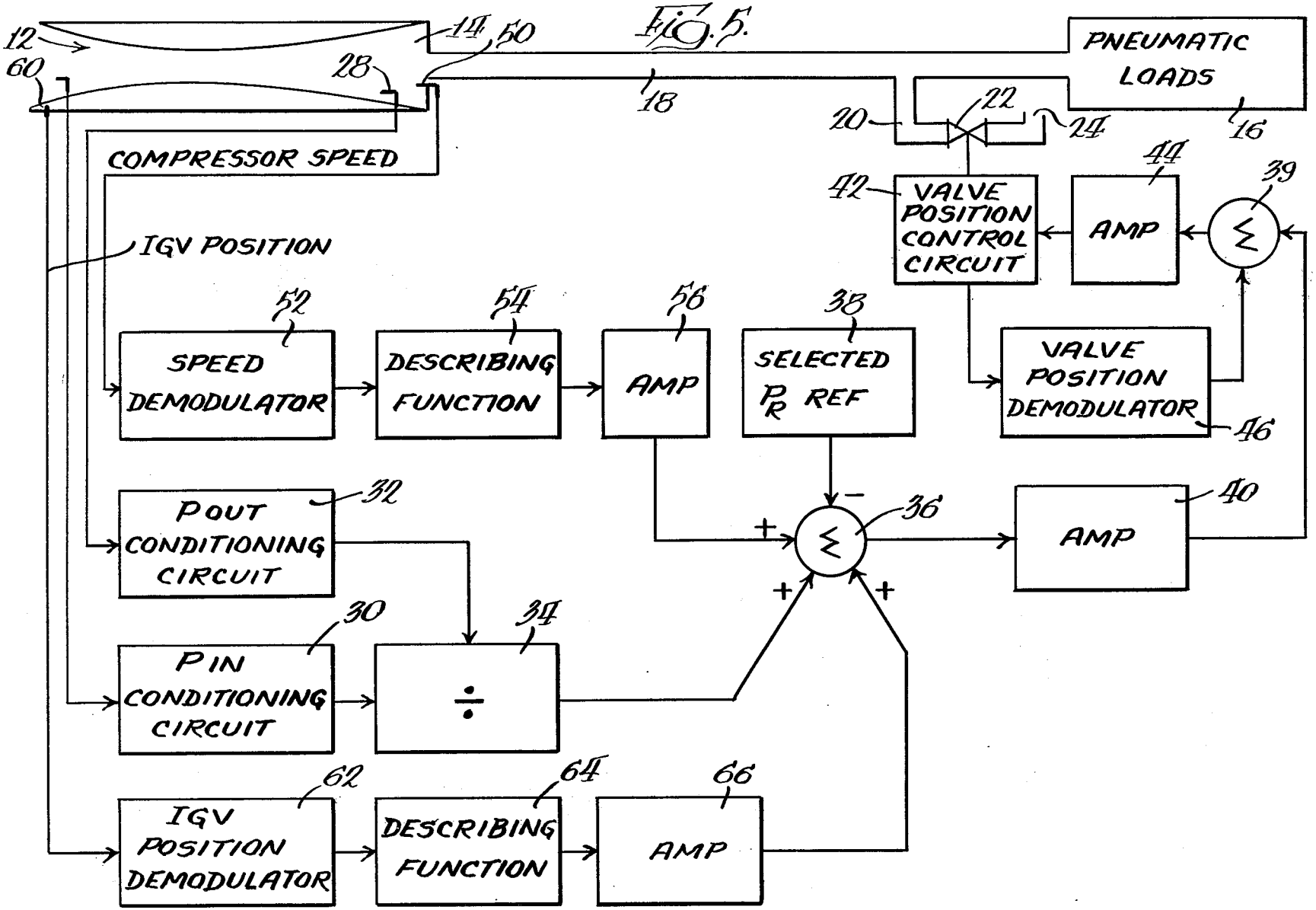
FIG. 5 is a block diagram of a surge control system for a variable speed, variable geometry compressor.

Referring to FIG. 5, the system for controlling surge in the variable speed, variable geometry compressor 68 is shown. The system is similar to that shown in FIG. 2 except that a signal representing compressor speed (similar to that provided by the system shown in FIG. 3) and a signal representing inlet guide vane position (similar to that shown by the circuit of FIG. 4) are applied to summer 36. The valve position command signal from summer 36 is provided in a manner similar to that discussed above, but is reduced by an amount proportional to the pressure ratio drop due to the particular position of the inlet guide vanes and the selected speed of the compressor.

We claim:

1. A surge control system for a compressor which provides air to a pneumatic load comprising:

means for generating a signal proportional to a pressure ratio of the outlet pressure of the compressor to the inlet pressure of the compressor;

means for generating a signal corresponding to a selected reference pressure ratio;

means for combining the signal proportional to the pressure ratio with the signal corresponding to the selected reference pressure ratio to provide a vent valve command signal representative of an impending surge condition and of a magnitude indicative of the amount of correction necessary to restore the compressor system to a desired operating condition; and a vent valve position control means responsive to said vent valve command signal for regulating a valve which vents a portion of the air to the pneumatic load in an amount proportional to said vent valve command signal.

2. The surge control system of claim 1 wherein said vent valve command signal is of one polarity when the signal proportional to the pressure ratio is greater in magnitude than the signal corresponding to the selected reference pressure ratio, and of the opposite polarity when the signal corresponding to the selected reference pressure ratio is greater in magnitude than the signal proportional to the pressure ratio.

3. The surge control system of claim 2 wherein said vent valve position control means is responsive only to the valve command signal of a polarity indicative of the signal proportional to the pressure ratio being greater in magnitude than the signal corresponding to the selected reference pressure ratio.

4. The surge control system of claim 1 wherein said means for generating a signal proportional to said pressure ratio includes:

means for providing a signal proportional to the outlet pressure;

means for providing a signal proportional to the inlet pressure; and means for dividing the signal proportional to the outlet pressure by a signal proportional to the inlet pressure to provide the signal proportional to said pressure ratio.

5. The surge control system of claim 1 wherein said combining means is a summer.

6. The surge control system of claim 1 wherein said vent valve position control means includes:

a summer receiving said vent valve command signal;

a valve position control circuit for positioning the valve coupled to the output of the summer; and a valve position demodulator for providing a signal to said summer indicative of the position of the valve.

7. A surge control system for a variable speed compressor which provides air to a pneumatic load comprising:

means for generating a signal proportional to a pressure ratio of the outlet pressure of the compressor to the inlet pressure of the compressor;

means for generating a signal corresponding to the speed of the compressor;

means for combining the signal proportional to a pressure ratio with the signal corresponding to the speed of the compressor to provide a vent valve command signal representative of an impending surge condition and of a magnitude indicative of the amount of correction necessary to restore the compressor system to a desired operating condition; and a vent valve position control means responsive to said vent valve command signal for regulating a valve which vents a portion of the air to the pneumatic load in an amount proportional to said vent valve command signal.

8. The surge control system of claim 7 wherein said means for generating a signal corresponding to the speed of the compressor includes means for increasing said signal in magnitude as the speed of the compressor decreases.

9. A surge control system for a variable geometry compressor which provides air to a pneumatic load comprising:

means for generating a signal proportional to a pressure ratio of the outlet pressure of the compressor to the inlet pressure of the compressor;

means for generating a signal corresponding to inlet guide vane position;

means for combining the signal proportional to the pressure ratio with the signal corresponding to the inlet guide vane position to provide a vent valve command signal representative of an impending surge condition and of a magnitude indicative of the amount of correction necessary to restore the compressor system to a desired operating condition; and a vent valve position control circuit responsive to said vent valve command signal for regulating a valve which vents a portion of the air to the pneumatic load in an amount proportional to said vent valve command signal.

10. The surge control system of claim 9 wherein said means for generating a signal corresponding to inlet guide vane position includes means for increasing said signal in magnitude as inlet guide vane position changes so as to cause an increase in air weight flow rate through the compressor.

11. A surge control system for a variable speed, variable geometry compressor which provides air to a pneumatic load comprising:

means for generating a signal proportional to a pressure ratio of the outlet pressure of the compressor to the inlet pressure of the compressor;

means for generating a signal corresponding to the speed of the compressor;

means for generating a signal corresponding to inlet guide vane position;

means for combining the signal proportional to the pressure ratio with the signal corresponding to the speed of the compressor and the signal corresponding to inlet guide vane position to provide a vent valve command signal; and a vent valve position control circuit responsive to vent valve command signal for regulating a valve which vents a portion of the air to the pneumatic load in an amount proportional to said vent valve command signal.

12. The surge control system of claim 11 wherein said means for generating a signal corresponding to the speed of the compressor includes means for increasing said signal in magnitude as the speed of the compressor decreases.

13. The surge control system of claim 11 wherein said means for generating a signal corresponding to inlet guide vane position includes means for increasing said signal in magnitude as inlet guide vane position changes so as to cause an increase in air weight flow rate through the compressor.

* * * * *